US009890555B1

(12) United States Patent
Woodall et al.

(10) Patent No.: US 9,890,555 B1
(45) Date of Patent: Feb. 13, 2018

(54) PORTABLE SHELTER

(71) Applicants: Robert Woodall, Panama City, FL (US); Felipe Garcia, Panama City, FL (US)

(72) Inventors: Robert Woodall, Panama City, FL (US); Felipe Garcia, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/203,930

(22) Filed: Jul. 7, 2016

(51) Int. Cl.
*E04H 15/54* (2006.01)
*E04H 15/44* (2006.01)
*E04H 15/64* (2006.01)

(52) U.S. Cl.
CPC ..... *E04H 15/54* (2013.01); *E04H 15/44* (2013.01); *E04H 15/64* (2013.01)

(58) Field of Classification Search
None
See application file for complete search history.

(56) References Cited

U.S. PATENT DOCUMENTS 2,599,141 A * 6/1952 Taylor ..... A01K 47/06 126/908
3,244,186 A * 4/1966 Thomason ..... E04H 3/16 126/569
6,491,051 B2 * 12/2002 Pierce ..... E04H 15/12 135/120.3
7,137,399 B1 * 11/2006 Ransom ..... E04H 15/32 135/121
8,056,953 B2 * 11/2011 Kiskiras ..... B64C 1/40 296/181.6
8,534,305 B1 * 9/2013 Woodall ..... E04H 15/12 135/115
9,371,665 B2 * 6/2016 Herpin ..... E04H 15/40
9,512,632 B2 * 12/2016 Cook ..... E04H 15/54
2010/0059095 A1 * 3/2010 Hinz ..... E04H 15/54 135/120.1
2011/0094555 A1 * 4/2011 Franta ..... E04H 15/001 135/143
2016/0096348 A1 * 4/2016 Maruyama ..... A45B 25/18 442/286

* cited by examiner

*Primary Examiner* — Noah Chandler Hawk
(74) *Attorney, Agent, or Firm* — James T. Shepherd

(57) ABSTRACT

A structure, which can be used as a portable shelter or tent, has a cover and structural elements disposed therein to permit the cover to lay flat or stand erect. The cover has two layers, one layer being thermally reflective and another layer being thermally absorptive. Similarly constructed removable panels can be attached to standoffs incorporated into the cover. The structure is reversible, so that the structure can either reject or absorb ambient heat. The standoffs are provided on each side of the cover and connections for attaching the removable panels to the standoffs are provided on each side of the removable panels. In this way, the removable panels can be attached to the interior or exterior of the structure with either side of a removable panel facing towards the cover.

19 Claims, 2 Drawing Sheets

PORTABLE SHELTER

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates to portable shelters. More particularly, the present invention relates to light-weight shelters with reversible thermal panels for interior heating and cooling.

(2) Description of the Prior Art

There is always a need for light-weight, easy to deploy structures geared toward the comfort and survivability of campers, military personnel, and even refugees and other indigenous people in poor countries. Some areas of the world can experience nearly 300 sunny days per year, maximum temperatures of near 95° F. to lows around 20° F. and constant winds ranging from 5 miles per hour (MPH) to 14 MPH, all in a relatively arid climate yielding wind chills near zero degrees Fahrenheit. Rainfall averages in these areas are often less than 12 inches per year.

Conventional tents utilized in cold weather tend to form warm vapor on inside tent surfaces, making conditions inside unpleasant. The water that condenses from the vapor, if retrievable, would be a benefit in arid areas. For example, on a typical evening in such conditions, about one cup of water from a person's exhaled air can condense on a tent wall surface and begin to drip on occupants, which can be a serious problem. In a tent built for two this could result in as much as sixteen ounces of water being dripped onto occupants and gear making the environment cold, wet, and uncomfortable. These tents also typically have poor thermal control features.

Thus, a need has been recognized for a structure useable as a tent that is easily deployable and storable, and that also provides thermal comfort to those within the structure in extremes of hot and cold. Additionally, the structure needs to prevent water condensation from dripping onto occupants and other contents within such a structure. Further, the structure should enable recovery of water condensate within the structure.

SUMMARY OF THE INVENTION

It is therefore a general purpose and primary object of the present invention to provide a structure, useable as a tent, having a first cover and structural elements disposed therein to permit the first cover to lay flat or stand erect. The first cover has at least two layers. One such layer reflects ambient heat and another layer absorbs ambient heat. Similarly constructed removable panels can be attached to standoffs incorporated in the structure.

As a result, the structure can stand erect with either one of the layers directed outwards and the other inwards. This permits a user to readily deploy the structure in either a cooling or heating mode, or fold it for easy storage. The structure defines an enclosed living space which is cooled or heated with respect to the ambient environment depending on which layer is outwardly disposed. Additional ambient cooling or heating can be provided by appropriately attaching the removable panels. The standoffs separate the removable panels from the first cover and provide an air space between the cover and panels for increased efficiency in cooling and heating.

The structure can have a detachable base with a cavity fillable with fluid such as air or water, to give the structure added stability, particularly in high winds, and provide thermal inertia to insulate the enclosed space from the ground. The structure can also have a water collector that uses the lotus effect to collect condensate on the top of the enclosed space to prevent the condensate from dripping on an occupant, and to permit recapture and reuse of the water, a particular advantage in dry environments.

In one embodiment, a structure includes a cover having a pair of sides. A first layer disposed on one side is fabricated of a material selected to reflect ambient heat from the first layer. A second layer disposed on an opposite side is fabricated of a material selected to absorb ambient heat. A plurality of structural members are disposed in the cover and permit the cover selectably to lay flat or to stand erect to define an interior space within the cover. The structural members are further disposed to selectably permit either the first layer or the second layer to be disposed in the interior space.

A plurality of panels is removably attachable to either side of the cover. Each of the panels has one side fabricated of the first layer and an opposite side fabricated of the second layer. The structure further includes another structural member disposed within each of the panels effective to permit the panels selectably to fully extend or to fold flat and compact.

A plurality of standoffs are attached about the cover, such that the panels attach to the standoffs. The standoffs are attached about the cover adjacent the structural members. The standoffs have a thickness to provide an air gap between the cover and the panels attached to the standoffs. The standoffs can have varying thicknesses to provide varying air gaps and the standoffs can be removably attached about the cover. The structure can also include a base removably connected to the cover, with the base extending beyond a perimeter of the cover to provide anchorage for said structure.

In one embodiment, a portable pop-up shelter includes a cover having an ambient heat reflective layer on one side and an ambient heat absorptive layer on an opposite side. A plurality of spring loops is disposed in the cover and arranged to permit the cover to be selectably laid flat or stood erect to define an interior space of the shelter. The spring loops are further arranged to selectably permit either of the reflective layer or the absorptive layer to be disposed within the interior space.

A plurality of standoffs are attached to the cover, with a number of the standoffs being attached to and extending away from the reflective layer and a remainder of the standoffs being attached to and extending away from the absorptive layer. A plurality of panels are removably attachable to the standoffs on either side of the cover. Each panel has an ambient heat reflective layer on one side and an ambient heat absorptive layer on an opposite side.

The shelter further includes a spring loop disposed within each of the panels, so as to permit the panels to fully extend or to fold flat and compact. The standoffs have a thickness so as to provide an air gap between the cover and the panels attached to the standoffs. The standoffs can be removably attached about the cover adjacent the spring loops. The standoffs can have varying thicknesses to provide varying air gaps. The shelter can include a base removably connected to the cover. The base can extend beyond a perimeter of the cover to provide anchorage for the shelter.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like references numerals and symbols designate identical or corresponding parts throughout the several views and wherein.

DESCRIPTION OF THE INVENTION

Figure 1:
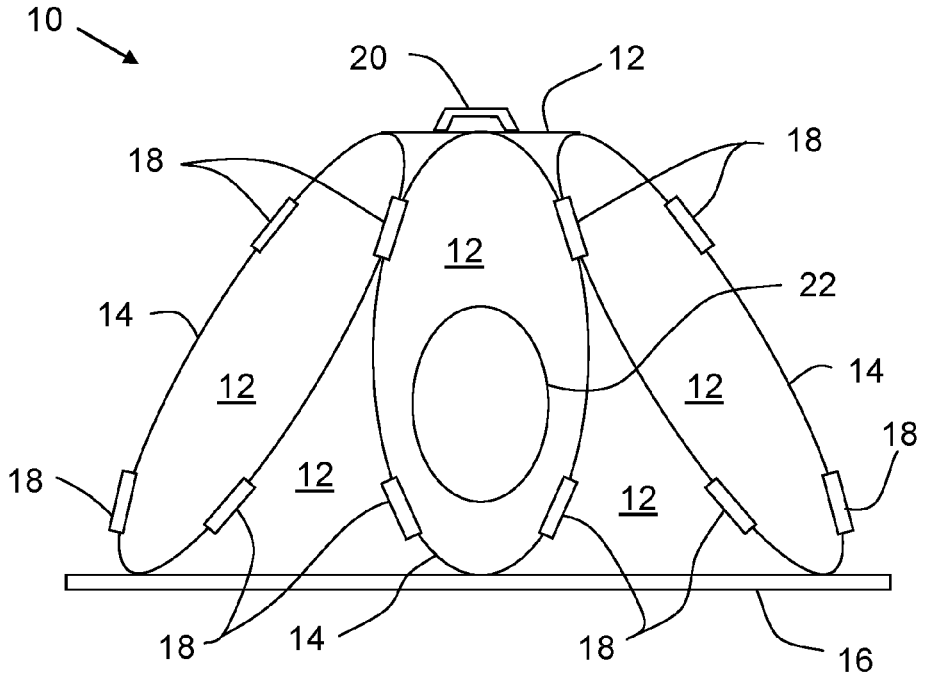
FIG. 1 is an elevation view of one embodiment of the invention.

Referring now to FIG. 1, there is shown a structure 10 having a cover 12, preferably in the form of a fabric shell, into which is sewn, in any conventional manner about cover 12's periphery, spring loops 14. Cover 12 mounts on an optional base 16, which may be detachable. Standoff blocks 18 are attached to structure 10. More particularly, blocks 18 are attached to cover 12 at points along spring loops 14.

Spring loops 14 make structure 10 a pop-up structure such that, by use of the outward force of spring loops 14, and by pushing or pulling structure 10 in the vicinity of handle 20, one can cause structure 10 to flatten or to deploy upright as shown in FIG. 1. More importantly structure 10 is reversible and can be deployed with either side of cover 12 outwardly facing, or either side inwardly facing. For full reversibility, blocks 18 are attached on both sides of cover 12, such that blocks 18 are both outwardly facing and inwardly facing.

The combination of cover 12 and spring loops 14 permit structure 10 to be folded and laid flat such that spring loops 14 can be disposed one on top of each other, and then the loops twisted, perhaps several times, in figure-eight patterns to fold structure 10 into a compact size suitable for easy storage in a relatively small space. Such pop-up structures are usable as quick-deployable tents, and structure 10 is illustrated as a tent. Sealable door flap 22 permits entry and exit.

Figure 2:
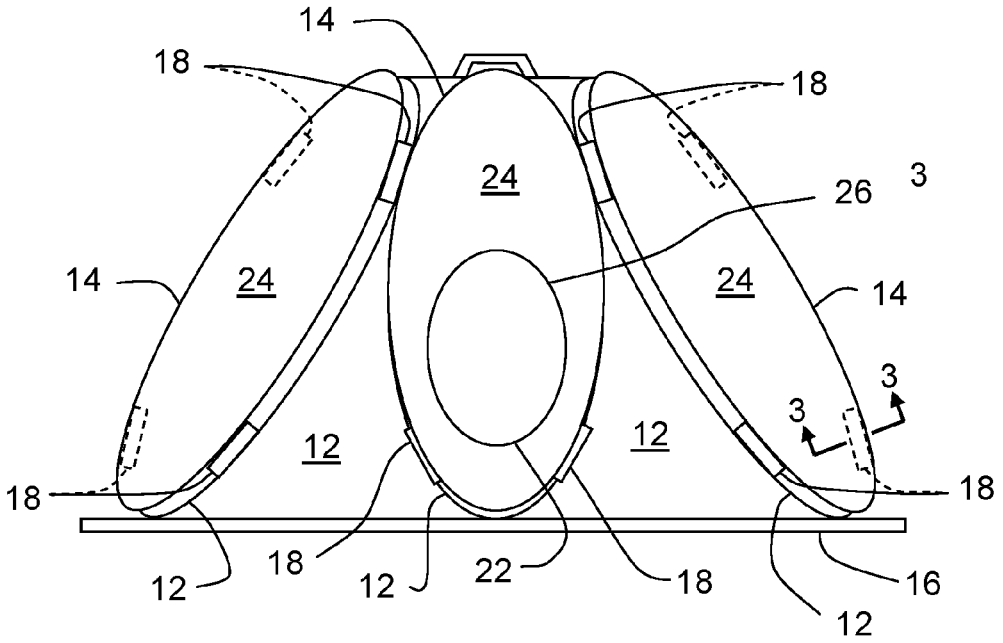
FIG. 2 is an elevation view of the invention showing the installation of removable panels on the structure.

Referring now also to FIG. 2, removable panels 24 are shown disposed over cover 12. As with cover 12, removable panels 24 are preferably in the form of a fabric shell, into which are sewn, in any conventional manner about the periphery of removable panels 24, additional spring loops 14. Accordingly, removable panels 24 also can fold into a compact size suitable for easy storage in a relatively small space. Sealable door covering 26 permits access to door flap 22. For ease of access, door covering 26 may be removable.

Figure 3:
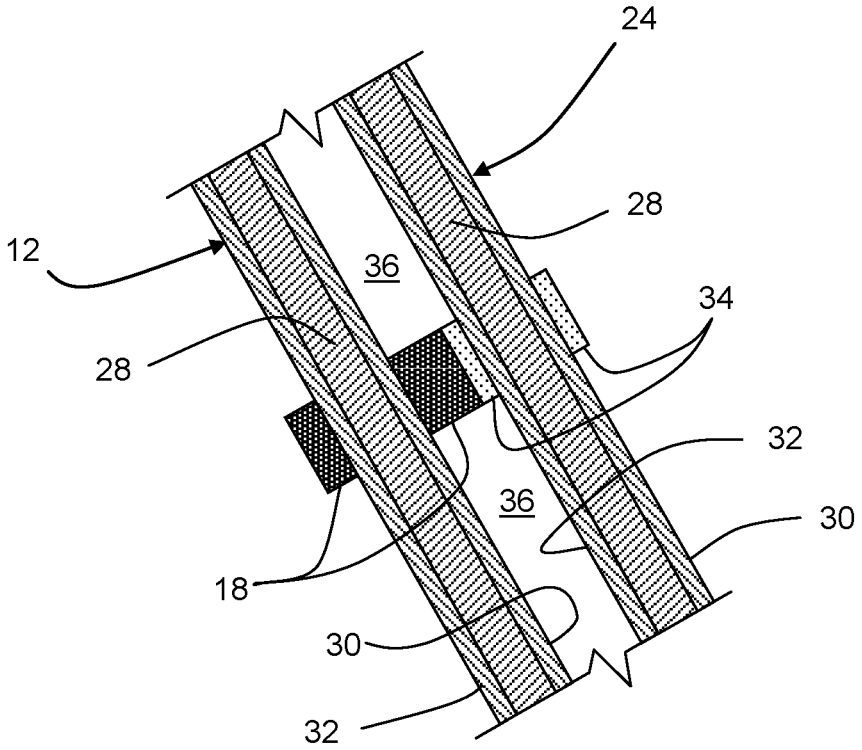
FIG. 3 is a detailed sectional view taken along line 3-3 of FIG. 2.

Referring now to FIG. 3, there is shown a cross-sectional view of removable panels 24 attached to cover 12 of structure 10, taken at line 3-3 of FIG. 2. Cover 12 and removable panels 24 are each seen to have a fabric base 28 on which are layers 30 and 32, one of which is thermally reflective, and one of which is thermally absorbent. Note that layers 30 and 32 can also be in direct contact with each other, eliminating the need for fabric base 28.

Standoffs 18 are affixed to opposite sides of cover 12. Connections 34 are affixed to opposite sides of removable covering 24. Connections 34 mate with standoffs 18 when removable panels 24 are placed about structure 10. Standoffs 18 provide air space 36 between cover 12 and removable covering 24. As can be seen in FIG. 3, standoffs 18 can be of differing thicknesses on opposite sides of cover 12 to provide a larger or smaller air space 36. Additionally, standoffs 18 can be removably attached to cover 12, thus providing the opportunity to attach standoffs 18 of varying thicknesses for differing environmental conditions.

In practice, in a hot environment, one deploys structure 10 with the thermally reflective (i.e., heat reflecting) side of cover 12 outwardly disposed to reject solar heat and thus keep the inside of structure 10 cooler than would be possible without the reflective surface. Removable panels 24 can be attached to the outside of structure 10, as shown in FIGS. 2 and 3, also with the thermally reflective (i.e., heat reflecting) side of removable panels 24 outwardly disposed. Removable panels 24 serve to further reduce the thermal load on the tent by both reflection and shading. Additionally, air gap 36 induces air convection between cover 12 and removable panels 24 to further reduce the thermal load.

Conversely, if structure 10 is in a cold environment, one would deploy structure 10 with the thermally absorbent (i.e., solar absorptive) side of cover 12 outward to take in heat from the environment. Removable panels 24 can further be deployed within structure 10 with the thermally absorbent side of removable panes 24 also outward. In this manner, the thermally absorbent side of cover 12 absorbs ambient heat and in turn heats through to the opposite side of cover 12.

Air gap 36 conveys heat to thermally absorbent side of removable panels 24, which heats through to the opposite side of removable panels 24, thus warming the inside of structure 10. Air gap 36 can be minimized by minimizing the thickness of standoffs 18. In so doing, it is possible to have direct heat transfer between cover 12 and removable panels 24.

As can be seen in FIG. 3, connections 34 not only provide for removable panels 24 to be removable, but also removable panels 24 are reversible. The reversible nature of structure 10 and removable panels 24, as well as the use of removable panels 24 both external and internal to structure 10, allow for the structure 10 to be configurable for all thermal environments. For example, conditions on a cool spring day may warrant structure 10 be in a thermally absorbent configuration, i.e., having a thermally absorbent layer facing outward. However, one or more of removable panels 24 attached to the outside of structure 10 may have a thermally reflective layer facing outward to reflect away a portion of the solar gain.

The material constituting cover 12 may be one of a number of fabric textile materials that can be metalized with a highly ultraviolet/infrared (UV/IR) reflective coating on one side and a black matte metallic coating on the other. The black matte coating does not necessarily have to be metallic but a metallic coating is preferable for enhanced thermal transmission of absorbed radiation to the interior of structure 10 when in the heating configuration indicated above.

While many different composite fabric choices may be employed, a particularly advantageous choice for simplicity and durability is a light-weight Mylar/Kevlar/Mylar composite metal coated on one side with highly reflective aluminum or silver oxide, and coated on the other side with a black metal oxide such as Black-Chrome for solar radiation absorption.

As is known in the art, cover 12 can include a band of moisture absorbing fabric (not shown) running the circumference of cover 12. Warm, moist exhaled air from occupants encountering a cooler interior wall can condense. The moisture absorbing fabric help keep moisture from pooling on the floor and wetting occupants or contents.

As also known in the art, base 16 can enclose a chamber (not shown) that one can fill with a fluid such as water, air, or the like to both thermally insulate the interior of structure 10 and provide a softer floor inside for sitting. If base 16 is filled with water and securely attached to cover 12, structure 10 will not require any external anchors to hold structure 10 in place during high winds. Additionally, a water filled base 16 will help moderate the temperature inside via thermal mass.

By extending base 16 beyond the periphery of cover 12, as shown in FIGS. 1 and 2, base 16 can allow for external sand-bagging should such be desired by the user. Alternately, a separate fabric flap (not shown) can be incorporated into structure 10 for sand bagging purposes. Additionally, structure 10 can incorporate a moisture collection system. As is known to those of skill in the art, such systems can collect and recycle as much as 16 ounces of fresh water per day.

What has thus been described is a structure 10, which can be used as a portable shelter or tent. Structure 10 includes cover 12 and structural elements (spring loops 14) disposed therein to permit cover 12 to lay flat or stand erect. Cover 12 has at least two layers (30, 32), with one layer capable of reflecting ambient heat and another layer capable of absorbing ambient heat. Similarly constructed removable panels 24 can be attached to standoffs 18 incorporated in structure 10.

Structure 10 is reversible, so that structure 10 can either reject or absorb ambient heat, making structure 10 cooler in hot environments and warmer in cool environments. Standoffs 18 are provided on each side of cover 12, such that removable panels 24 can be attached to the interior or exterior of structure 10 to provide additional cooling or warming for occupants within structure 10. Connections 34 for attaching removable panels 24 to standoffs 18 are provided on both sides of removable panels 24, such that either side of removable panel 24 can face towards cover 12. Additionally, standoffs 18 can be removably attached to cover 12 and various standoffs 18 can have varying thicknesses. Accordingly, the size of air gap 36 formed between cover 12 and removable panels 24 can be varied.

Obviously many modifications and variations of the present invention may become apparent in light of the above teachings. For example, the materials forming cover 12 and removable panels 24 can be any number of materials known to those of skill in the art to reflect or absorb ambient heat. Removable panels 24 need not be constructed of the same materials as cover 12 and differing removable panels 24 may be constructed of differing material.

Standoffs 18 can be constructed of varying material, such as neoprene or other plastics, provided they are constructed with sufficient stiffness to maintain air gap 36 between cover 12 and removable panels 24, as well as being able to withstand expected environmental conditions over extended time periods. Standoffs 18 can be attached to cover 12 in any manner known to those in the art, including being sewn into cover 12. For removable standoffs 18, mating Velcro strips can be attached to cover 12 and standoffs 18.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A structure, comprising:

a cover having a pair of sides;

a first layer disposed on one of said pair of sides, said first layer comprising a material selected to reflect ambient heat from said first layer;

a second layer disposed on an opposite side of said pair of sides, said second layer comprising a material selected to absorb ambient heat;

a plurality of structural members disposed in said cover effective to permit said cover selectably to lay flat, or to stand erect effective to define an interior space within said cover, said plurality of structural members being disposed effective to selectably permit either of said first layer or said second layer to be disposed in said interior space; and a plurality of panels removably attachable to either side of said cover, each of said plurality of panels having a pair of panel sides, one of said pair of panel sides comprising a material selected to reflect ambient heat therefrom, and the other of said pair of panel sides comprising a material selected to absorb ambient heat.

2. The structure of claim 1, further comprising a further structural member disposed within each of said plurality of panels, said further structural member effective to permit said panels selectably to fully extend or to fold flat.

3. The structure of claim 2, further comprising a plurality of standoffs attached to said cover, wherein said panels attach to said standoffs.

4. The structure of claim 3, wherein said standoffs are attached to said cover adjacent to said structural members.

5. The structure of claim 4, wherein said standoffs have a thickness to provide an air gap between said cover and said panels attached to said standoffs.

6. The structure of claim 5, wherein said standoffs have varying thicknesses to provide varying air gaps.

7. The structure of claim 6, wherein said standoffs are removably attached to said cover.

8. The structure of claim 7, further comprising a base removably connected to said cover, said base extending beyond a perimeter of said cover to provide anchorage for said structure.

9. The structure of claim 1, further comprising a plurality of standoffs attached to said cover adjacent to said structural members, wherein said panels attach to said standoffs.

10. The structure of claim 9, wherein said standoffs have a thickness to provide an air gap between said cover and said panels attached to said standoffs.

11. The structure of claim 10, wherein said standoffs have varying thicknesses to provide varying air gaps.

12. A portable pop-up shelter, comprising:

a cover having an ambient heat reflective layer on one side and an ambient heat absorptive layer on an opposite side;

a plurality of spring loops disposed in said cover and arranged to permit said cover to be selectably laid flat or stood erect to define an interior space of said shelter, said plurality of spring loops further being arranged to selectably permit either of said reflective layer or said absorptive layer to be disposed within said interior space;

a plurality of standoffs attached to said cover, a number of said standoffs being attached to and extending away from said reflective layer and a remainder of said standoffs being attached to and extending away from said absorptive layer; and a plurality of panels removably attachable to said standoffs on either side of said cover, each of said plurality of panels having an ambient heat reflective layer on one side and an ambient heat absorptive layer on an opposite side.

13. The shelter of claim 12, further comprising a further spring loop disposed within each of said plurality of panels, said further spring loop effective to permit said panels selectably to fully extend or to fold flat and compact.

14. The shelter of claim 12, wherein said standoffs have a thickness to provide an air gap between said cover and said panels attached to said standoffs.

15. The shelter of claim 14, wherein said standoffs are removably attached to said cover adjacent to said spring loops.

16. The shelter of claim 15, wherein said standoffs have varying thicknesses to provide varying air gaps.

17. The shelter of claim 16, further comprising a further spring loop disposed within each of said plurality of panels, said further spring loop effective to permit said panels selectably to fully extend or to fold flat and compact.

18. The shelter of claim 17, further comprising a base removably connected to said cover, said base extending beyond a perimeter of said cover to provide anchorage for said shelter.

19. The shelter of claim 12, further comprising a base removably connected to said cover, said base extending beyond a perimeter of said cover to provide anchorage for said shelter.

* * * * *